US007971814B2

(12) United States Patent
Evans et al.

(10) Patent No.: US 7,971,814 B2
(45) Date of Patent: Jul. 5, 2011

(54) NON-SYMMETRICAL AIRLOCK FOR BLOWING WOOL MACHINE

(75) Inventors: Michael E. Evans, Granville, OH (US); Christopher M. Relyea, Columbus, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 47 days.

(21) Appl. No.: 12/336,786

(22) Filed: Dec. 17, 2008

(65) Prior Publication Data

US 2010/0147983 A1 Jun. 17, 2010

(51) Int. Cl.
*B02C 19/00* (2006.01)

(52) U.S. Cl. ..... 241/60; 241/98

(58) Field of Classification Search ..... 241/60, 241/134, 141, 277, 136, 278.1, 278.2, 98, 241/605, 165.5

See application file for complete search history.

(56) References Cited

U.S. PATENT DOCUMENTS

| | | | | |
|---|---|---|---|---|
| 313,251 | A | 3/1885 | Taylor | |
| 1,630,542 | A | 5/1927 | Schulz | |
| 1,718,507 | A | 6/1929 | Wenzel et al. | |
| 1,811,898 | A | 6/1931 | Schur et al. | |
| 2,049,063 | A | 7/1936 | Hubbard | |
| 2,057,121 | A | 10/1936 | Trevellyan | |
| 2,057,122 | A | 10/1936 | Trevellyan | |
| 2,193,849 | A | 3/1940 | Whitfield | |
| 2,200,713 | A | 5/1940 | Ericson et al. | |
| 2,235,542 | A | 3/1941 | Wenzel | |
| 2,262,094 | A | 11/1941 | Burt | |
| 2,273,962 | A | 2/1942 | Hubbard | |
| 2,291,871 | A * | 8/1942 | Bokum et al. | 406/102 |
| 2,308,197 | A | 1/1943 | Meyer | |
| 2,311,773 | A | 2/1943 | Patterson | |
| 2,355,358 | A | 8/1944 | Anderson | |
| 2,404,678 | A | 7/1946 | Erb | |
| 2,437,831 | A | 3/1948 | Moore | |
| 2,532,318 | A | 12/1950 | Mackey et al. | |

(Continued)

FOREIGN PATENT DOCUMENTS

DE 3238492 4/1984

(Continued)

OTHER PUBLICATIONS

Hearing Testimony, Case No. 09 CV 263 Division 2, Boulder County District Court, Colorado, Apr. 28, 2009, 11 pages.

(Continued)

*Primary Examiner* — Faye Francis

(74) *Attorney, Agent, or Firm* — MacMillan, Sobanski & Todd, LLC

(57) ABSTRACT

A machine for distributing blowing wool from a bag of compressed blowing wool is provided. The machine includes a shredding chamber having an outlet end. The shredding chamber includes a plurality of shredders configured to shred and pick apart the blowing wool. A discharge mechanism is mounted at the outlet end of the shredding chamber and is configured for distributing the blowing wool into an airstream. The discharge mechanism includes a housing and a plurality of sealing vane assemblies mounted for rotation. The housing has a wrap angle of approximately 240°. The sealing vane assemblies are configured to seal against the housing as the sealing vane assemblies rotate. The housing includes an eccentric segment extending from the housing. A blower is configured to provide the airstream flowing through the discharge mechanism. The sealing vane assemblies become spaced apart from the housing as the sealing vane assemblies rotate through the eccentric segment.

7 Claims, 6 Drawing Sheets

U.S. PATENT DOCUMENTS 2,532,351 A 12/1950 Wedebrock
2,550,354 A 4/1951 Jacobsen
2,618,817 A 11/1952 Slayter
2,721,767 A 10/1955 Kropp
2,754,995 A 7/1956 Switzer
2,794,454 A 6/1957 Moulthrop
2,869,793 A 1/1959 Montgomery
2,938,651 A 5/1960 Specht et al.
2,964,896 A 12/1960 Finocchiaro
2,984,872 A 5/1961 France
2,989,252 A 6/1961 Babb
3,051,398 A 8/1962 Babb
3,076,659 A 2/1963 Kremer
3,175,866 A 3/1965 Nichol
3,201,007 A 8/1965 Transeau
3,231,105 A 1/1966 Easley
3,278,013 A 10/1966 Banks
3,314,732 A 4/1967 Hagan
3,399,931 A 9/1968 Vogt
3,403,942 A 10/1968 Farnworth
3,485,345 A 12/1969 Deasy
3,512,345 A 5/1970 Smith
3,556,355 A 1/1971 Ruiz
3,591,444 A 7/1971 Hoppe et al.
3,703,970 A 11/1972 Benson
3,747,743 A 7/1973 Hoffmann, Jr.
3,861,599 A 1/1975 Waggoner
3,869,337 A 3/1975 Hoppe et al.
3,895,745 A 7/1975 Hook
3,952,757 A 4/1976 Huey
3,995,775 A 12/1976 Birkmeier et al.
4,059,205 A 11/1977 Heyl
4,111,493 A * 9/1978 Sperber ..... 406/64
4,129,338 A 12/1978 Mudgett
4,133,542 A 1/1979 Janian et al.
4,134,508 A 1/1979 Burdett, Jr.
4,151,962 A * 5/1979 Calhoun et al. ..... 241/60
4,155,486 A 5/1979 Brown
4,179,043 A 12/1979 Fischer
4,180,188 A 12/1979 Aonuma et al.
4,236,654 A 12/1980 Mello
4,268,205 A 5/1981 Vacca et al.
4,273,296 A 6/1981 Hoshall
4,337,902 A 7/1982 Markham
4,344,580 A 8/1982 Hoshall et al.
4,346,140 A 8/1982 Carlson et al.
4,365,762 A 12/1982 Hoshall
4,381,082 A 4/1983 Elliott et al.
4,411,390 A 10/1983 Woten
4,465,239 A 8/1984 Woten
4,536,121 A 8/1985 Stewart et al.
4,537,333 A 8/1985 Bjerregaard
4,560,307 A 12/1985 Deitesfeld
4,585,239 A 4/1986 Nicholson
4,640,082 A 2/1987 Gill
4,695,501 A 9/1987 Robinson
4,716,712 A 1/1988 Gill
4,784,298 A 11/1988 Heep et al.
4,880,150 A 11/1989 Navin et al.
4,915,265 A 4/1990 Heep et al.
4,919,403 A 4/1990 Bartholomew
4,978,252 A 12/1990 Sperber
5,014,885 A 5/1991 Heep et al.
5,037,014 A 8/1991 Bliss
5,052,288 A 10/1991 Marquez et al.
5,129,554 A 7/1992 Futamura
5,156,499 A 10/1992 Miklich
5,166,236 A 11/1992 Alexander et al.
5,289,982 A 3/1994 Andersen
5,303,672 A 4/1994 Morris
5,323,819 A 6/1994 Shade
5,368,311 A 11/1994 Heyl
5,380,094 A 1/1995 Schmidt et al.
5,392,964 A 2/1995 Stapp et al.
5,405,231 A 4/1995 Kronberg
5,462,238 A 10/1995 Smith et al.
5,472,305 A 12/1995 Ikeda et al.
5,511,730 A 4/1996 Miller et al.
5,601,239 A 2/1997 Smith et al.
5,620,116 A 4/1997 Kluger et al.
5,624,742 A 4/1997 Babbitt et al.
5,639,033 A 6/1997 Miller et al.
5,642,601 A 7/1997 Thompson, Jr. et al.
5,647,696 A 7/1997 Sperber
5,683,810 A 11/1997 Babbitt et al.
5,819,991 A 10/1998 Khon et al.
5,829,649 A 11/1998 Horton
5,860,232 A 1/1999 Nathenson et al.
5,860,606 A 1/1999 Tiedeman et al.
5,927,558 A 7/1999 Bruce
5,934,809 A 8/1999 Marbler
5,987,833 A 11/1999 Heffelfinger et al.
5,997,220 A 12/1999 Wormser
6,004,023 A 12/1999 Koyanagi et al.
6,036,060 A 3/2000 Munsch et al.
6,070,814 A 6/2000 Deitesfeld
6,074,795 A 6/2000 Watamabe et al.
6,109,488 A 8/2000 Horton
6,161,784 A 12/2000 Horton
6,209,724 B1 4/2001 Miller
6,266,843 B1 7/2001 Doman et al.
6,296,424 B1 10/2001 Ecket et al.
6,312,207 B1 11/2001 Rautiainen
6,503,026 B1 1/2003 Mitchell
6,510,945 B1 1/2003 Allwein et al.
6,648,022 B2 11/2003 Pentz et al.
6,698,458 B1 3/2004 Sollars
6,779,691 B2 8/2004 Cheng
6,783,154 B2 8/2004 Persson et al.
6,796,748 B1 9/2004 Sperber
6,826,991 B1 12/2004 Rasmussen
7,284,715 B2 10/2007 Dziesinski et al.
7,354,466 B2 4/2008 Dunning et al.
2001/0036411 A1 11/2001 Walker
2003/0075629 A1 4/2003 Lucas
2003/0192589 A1 10/2003 Jennings
2003/0215165 A1 11/2003 Hogan et al.
2003/0234264 A1 12/2003 Landau
2004/0124262 A1 7/2004 Bowman et al.
2005/0006508 A1 1/2005 Roberts
2005/0242221 A1 11/2005 Rota
2006/0024456 A1 2/2006 O'Leary et al.
2006/0024457 A1 2/2006 O'Leary et al.
2006/0024458 A1 2/2006 O'Leary et al.
2006/0231651 A1 10/2006 Evans et al.
2007/0138211 A1 6/2007 O'Leary et al.
2008/0087751 A1 4/2008 Johnson et al.

FOREIGN PATENT DOCUMENTS

DE 3240126 5/1984
EP 0265751 4/1988
FR 2350450 3/1979
GB 1418882 12/1975
GB 1574027 9/1980
GB 2099776 12/1982
GB 2124194 2/1984
GB 2124194 A 2/1984
GB 2156303 10/1985
GB 2212471 7/1989
GB 2276147 9/1994
JP 407088985 4/1995
NL 8204888 7/1984

OTHER PUBLICATIONS

Hearing Testimony, Case No. 09 CV 263 Division 2, Boulder County District Court, Colorado, Apr. 29, 2009, 14 pages.
Hearing Testimony, Case No. 09 CV 263 Division 2, Boulder County District Court, Colorado, Apr. 30, 2009, 35 pages.
Hearing Testimony, Case No. 09 CV 263, Boulder County District Court, Colorado, May 1, 2009, 18 pages.
Hearing Testimony, Case No. 09 CV 263 Division 2, Boulder County District Court, Colorado, May 4, 2009, 27 pages.
Hearing Testimony, Case No. 09 CV 263 Division 2, Boulder County District Court, Colorado, May 5, 2009, 5 pages.
Hearing Testimony, Case No. 09 CV 263 Division 2, Boulder County District Court, Colorado, May 7, 2009, 8 pages.

Hearing Testimony, Case No. 09 CV 263 Division K, Boulder County District Court, Colorado, May 7, 2009, 8 pages.
Operator's Manual for Unisul's Mini-Matic Insulation Blowing Maching, Mfg. by UNISUL, Winter Haven, FL, Publication: RTL 100-08/03, CT0000310-CT0000322, 13 pages.
Attic Protector Blow-In Fiber Glass, Johns Manville International-Insulation Group RIG 1718, Denver, CO, www.jm.com, 08/00-REV, CT0000122-CT0000124, 3 page.
The Cyclone Insulation Blowing Machine, Intec, Frederick, CO, info@inteccorp.com, (Exhibit S), 2 pages.
Blow-Matic 8, Abiff Manufacturing Corp., Denver, CO, www.fiberiffic.com, Copyright 2002-2004 Ark-Seal, LLC, CT0000550-CT0000552, 3 pages.
Tiger II, Hoshall Equipmant, Division of Industrial Gaskel, Inc., Oklahoma City, OK, TWX9108313292 Ind Gasket OKC, CT0000555-CT0000556, 2 pages.
The Force/3 Insulation Blower, Intec, Frederick, CO, http://www.inteccorp.com/Force3.htm—Apr. 14, 2009, OC002923-OC002925, 3 pages.
The Quantum Insulation Blower, Intec, Frederick, CO, http://www.inteccorp.com/Quantum.htm—Apr. 14, 2009, OC002930-OC002931, 2 pages.
The Wasp Insulation Blower, Intec, Frederick, CO, http://www.intec-corp.com/Wasp.com—May 18, 2005, CT0000352-CT0000354, 3 pages.
Krendl #425, Krendl Machining Company, Delphos, OH, www.krendlmachine.com, Copyright Jan. 2009, CT000357-CT000358, 2 pages.
Krendl #250A, Krendl Machining Company, Delphos, OH, www.krendlmachine.com, Copyright Apr. 2008, CT000359-CT000360, 2 pages.
The Force/1, Intec, Frederick, CO, www.inteccorp.com, D200-0200-00, KL REV Mar. 2004, CT0000008-CT0000055, 50 pages.
Insulation Blowers—Accul 9118, Insulation Machine Corp., Springfield, MA, Copyright 2006, http://accuone.com/accul_9118.html—Apr. 4, 2009, CT0000056-CT0000057, 2 pages.
AccuOne 9400, AccuOne Industries, Inc., Copyright 1998, http://www.accu1.com/A9400.htm1—Jul. 13, 2004, CT0000059, 1 page.
Krendl #325, Krendl Machining Company, Delphos, OH, www.krendlmachine.com, CT0000060, 1 page.
Krendl #450A, Krendl Machining Company, Delphos, OH, http://www.krendlmachine.com/products/450a.asp?PartNo=450A—Jul. 13, 2004, CT0000067-CT0000068, 2 pages.
Cocoon Insulation, Cocoon, Charlotte, NC, Copyright 2003 U.S. Green Fiber, LLC and Copright 2003 by Lowe's, CT0000071-CT0000076, 6 pages.
X-Floc Minifant M99, X-Floc GmbH, Renningen, Germany, Mar. 18, 2009, http://www.x-floc.com/en/machines/minifant-m99.html—Apr. 6, 2009, CT0000449-CT0000451, 3 pages.
X-Floc Zellofant M95, X-Floc GmbH, Renningen, Germany, Feb. 8, 2009, http://www.x-floc.com/en/machines/zellofant-m95.html—Apr. 13, 2009, CT0000107-CT0000112, 6 pages.
Isoblow Mini, Isocell Vertriebs G.M.B.H., Neumarkt Am Wallersee, Austria, www.isocell.at/home-page/blowing-technology/isoblow-mini.html—Apr. 4, 2009, CT0000436-CT0000438, 3 pages.
Meyer Series 700, "Reliable Hydraulic Power on the Industry's Mot Versatile Platform", Copyright 2007 Wm. W. Meyer & Sons, Inc., Libertyville, IL, www.meyerinsulation.com, CT0000602-CT0000603, 2 pages.
InsulMaxx 1000, Spray Insulation Components, Oklahoma City, OK, http://www.sprayinsulation.com/catalog.asp—Jan. 4, 2008, CT0000606-CT0000608, 3 pages.
Cocoon-Attic Insulation Blowing Machine, Exhibit II, 2 pages.
U.S. Appl. No. 10/899,909—Advisory Action May 26, 2009.
U.S. Appl. No. 10/899,909—Response to Final May 12, 2009.
U.S. Appl. No. 10/899,909—Final Rejection Mar. 20, 2009.
U.S. Appl. No. 10/899,909—Rejection Sep. 20, 2007.
U.S. Appl. No. 10/899,909—Rejection Apr. 4, 2008.
U.S. Appl. No. 10/899,909—Rejection Sep. 9, 2008.
U.S. Appl. No. 10/899,909—Response Aug. 27, 2007.
U.S. Appl. No. 10/899,909—Response Dec. 20, 2007.
U.S. Appl. No. 10/899,909—Response May 16, 2008.
U.S. Appl. No. 10/899,909—Response Jan. 7, 2009.
U.S. Appl. No. 10/899,909—Restriction Jul. 31, 2007.
U.S. Appl. No. 11/024,093—3 month office action Mar. 2, 2007.
U.S. Appl. No. 11/024,093—3 month office action Jul. 12, 2007.
U.S. Appl. No. 11/024,093—3 month office action Mar. 5, 2009.
U.S. Appl. No. 11/024,093—Advisory Action Jan. 11, 2008.
U.S. Appl. No. 11/024,093—Final 3 month Oct. 24, 2007.
U.S. Appl. No. 11/024,093—RCE Jan. 22, 2008.
U.S. Appl. No. 11/024,093—Response Jan. 24, 2007.
U.S. Appl. No. 11/024,093—Response Jun. 4, 2007.
U.S. Appl. No. 11/024,093—Response Oct. 12, 2007.
U.S. Appl. No. 11/024,093—Response Dec. 20, 2007.
U.S. Appl. No. 11/024,093—Response May 28, 2009.
U.S. Appl. No. 11/024,093—Restriction Nov. 24, 2006.
U.S. Appl. No. 11/303,612—3 Month Oct. 15, 2009.
U.S. Appl. No. 11/303,612—Final 3 Month Apr. 30, 2009.
U.S. Appl. No. 11/452,554—3 Month Office Action Apr. 8, 2008.
U.S. Appl. No. 11/452,554—Advisory Action Feb. 6, 2009.
U.S. Appl. No. 11/452,554—Final 3 Month Oct. 15, 2008.
U.S. Appl. No. 11/452,554—Final 3 Month May 5, 2009.
U.S. Appl. No. 11/452,554—RCE Mar. 11, 2009.
U.S. Appl. No. 11/452,554—Response Jun. 4, 2008.
U.S. Appl. No. 11/452,554—Response After Final Jan. 14, 2009.
U.S. Appl. No. 11/581,660—3 month office May 28, 2009.
U.S. Appl. No. 11/581,661—3 Month Apr. 3, 2008.
U.S. Appl. No. 11/581,661—3 Month May 5, 2009.
U.S. Appl. No. 11/581,661—Advisory Action Jan. 27, 2009.
U.S. Appl. No. 11/581,661—Final 3 Month Dec. 3, 2008.
APSCO—Pneumatic Conveying: Dilute Phase Systems, Dense Phase Systems . . . .
Choosing a pneumatic conveying system . . . ; Powder Bulk Engineering; Steve Grant.
Nonaka-Yasuhiro, Japanese Trade-Journal, Article, Characteristics of Functional Chromium Plating and Its Application, , 1999.
PCT Search Report for PCT/US05/26256 dated Nov. 22, 2005.
PCT Search Report for PCT/US05/27124 dated Nov. 22, 2005.
U.S. Appl. No. 11/303612—Response Jan. 14, 2009.
U.S. Appl. No. 11/581,661—Response Jul. 17, 2008.
U.S. Appl. No. 11/303,612—Response AF Jun. 29, 2009.
U.S. Appl. No. 11/581,661—Response AF Jan. 9, 2009.
U.S. Appl. No. 11/581,661—Response; RCE Feb. 25, 2009.

* cited by examiner

NON-SYMMETRICAL AIRLOCK FOR BLOWING WOOL MACHINE

TECHNICAL FIELD

This invention relates to loosefil insulation for insulating buildings. More particularly this invention relates to machines for distributing packaged loosefil insulation.

BACKGROUND OF THE INVENTION

In the insulation of buildings, a frequently used insulation product is loosefil insulation. In contrast to the unitary or monolithic structure of insulation batts or blankets, loosefil insulation is a multiplicity of discrete, individual tufts, cubes, flakes or nodules. Loosefil insulation is usually applied to buildings by blowing the insulation into an insulation cavity, such as a wall cavity or an attic of a building. Typically loosefil insulation is made of glass fibers although other mineral fibers, organic fibers, and cellulose fibers can be used.

Loosefil insulation, commonly referred to as blowing wool, is typically compressed in packages for transport from an insulation manufacturing site to a building that is to be insulated. Typically the packages include compressed blowing wool encapsulated in a bag. The bags are made of polypropylene or other suitable material. During the packaging of the blowing wool, it is placed under compression for storage and transportation efficiencies. Typically, the blowing wool is packaged with a compression ratio of at least about 10:1. The distribution of blowing wool into an insulation cavity typically uses a blowing wool distribution machine that feeds the blowing wool pneumatically through a distribution hose. Blowing wool distribution machines typically have a large chute or hopper for containing and feeding the blowing wool after the package is opened and the blowing wool is allowed to expand.

It would be advantageous if blowing wool machines could be improved to make them easier to use.

SUMMARY OF THE INVENTION

The above objects as well as other objects not specifically enumerated are achieved by a machine for distributing blowing wool from a bag of compressed blowing wool. The machine includes a shredding chamber having an outlet end. The shredding chamber includes a plurality of shredders configured to shred and pick apart the blowing wool. A discharge mechanism is mounted at the outlet end of the shredding chamber and is configured for distributing the blowing wool into an airstream. The discharge mechanism includes a housing and a plurality of sealing vane assemblies mounted for rotation. The housing has a wrap angle of approximately 240°. The sealing vane assemblies are configured to seal against the housing as the sealing vane assemblies rotate. The housing includes an eccentric segment extending from the housing. A blower is configured to provide the airstream flowing through the discharge mechanism. The sealing vane assemblies become spaced apart from the housing as the sealing vane assemblies rotate through the eccentric segment.

According to this invention there is also provided a machine for distributing blowing wool from a bag of compressed blowing wool. The machine includes a shredding chamber having an outlet end. The shredding chamber includes a plurality of shredders configured to shred and pick apart the blowing wool. A discharge mechanism is mounted at the outlet end of the shredding chamber and configured for distributing the blowing wool into an airstream. The discharge mechanism has a side inlet a inner housing surface and a plurality of sealing vane assemblies mounted for rotation. A blower is configured to provide the airstream flowing through the discharge mechanism. At least of the two sealing vane assemblies are in contact with the inner housing surface in a pre-airstream area and at least one sealing vane assembly is in contact with the inner housing surface in a post-airstream area.

According to this invention there is also provided a machine for distributing blowing wool from a bag of compressed blowing wool. The machine includes a shredding chamber having an outlet end. The shredding chamber includes a plurality of shredders configured to shred and pick apart the blowing wool. A discharge mechanism is mounted at the outlet end of the shredding chamber and is configured for distributing the blowing wool into an airstream. The discharge mechanism includes a housing, an eccentric segment extending from the housing and an outlet plate. The eccentric segment defines an eccentric region. The outlet plate includes an outlet opening. A blower is configured to provide the airstream flowing through the discharge mechanism. The airstream causes a pressure within the discharge mechanism in a range of from about 1.5 psi to about 3.0 psi.

According to this invention there is also provided a machine for distributing blowing wool from a bag of compressed blowing wool. The machine includes a shredding chamber having an outlet end. The shredding chamber includes a plurality of shredders configured to shred and pick apart the blowing wool. A discharge mechanism is mounted to the outlet end of the shredding chamber and configured for distributing the blowing wool into an airstream. The discharge mechanism includes a housing, a side inlet, an eccentric region and a plurality of sealing vane assemblies mounted for rotation. The housing has a housing end and a wrap angle of approximately 240°. The sealing vane assemblies are configured to seal against the housing as the sealing vane assemblies rotate. The eccentric region has a left edge and a right edge. A blower is configured to provide the airstream flowing through the discharge mechanism. The left edge of the eccentric region forms an angle of at least 60° with the housing end.

According to this invention there is also provided a machine for distributing blowing wool from a bag of compressed blowing wool. The machine includes a shredding chamber having an outlet end. The shredding chamber includes a plurality of shredders configured to shred and pick apart the blowing wool. A discharge mechanism is mounted to the outlet end of the shredding chamber and configured for distributing the blowing wool into an airstream. The discharge mechanism includes a housing, an eccentric region and a plurality of sealing vane assemblies mounted for rotation. The housing has a top housing segment and a bottom housing segment. The eccentric region is positioned between the top housing segment and the bottom housing segment. The eccentric region has a left edge and a right edge. The left edge and right edge of the eccentric region form an angle. A blower is configured to provide the airstream flowing through the discharge mechanism. The left edge of the eccentric region forms an angle with a housing end that is greater than the angle formed between the left edge and right edge of the eccentric region.

Various objects and advantages of this invention will become apparent to those skilled in the art from the following detailed description of the preferred embodiment, when read in light of the accompanying drawings.

DETAILED DESCRIPTION OF THE INVENTION

Figure 1:
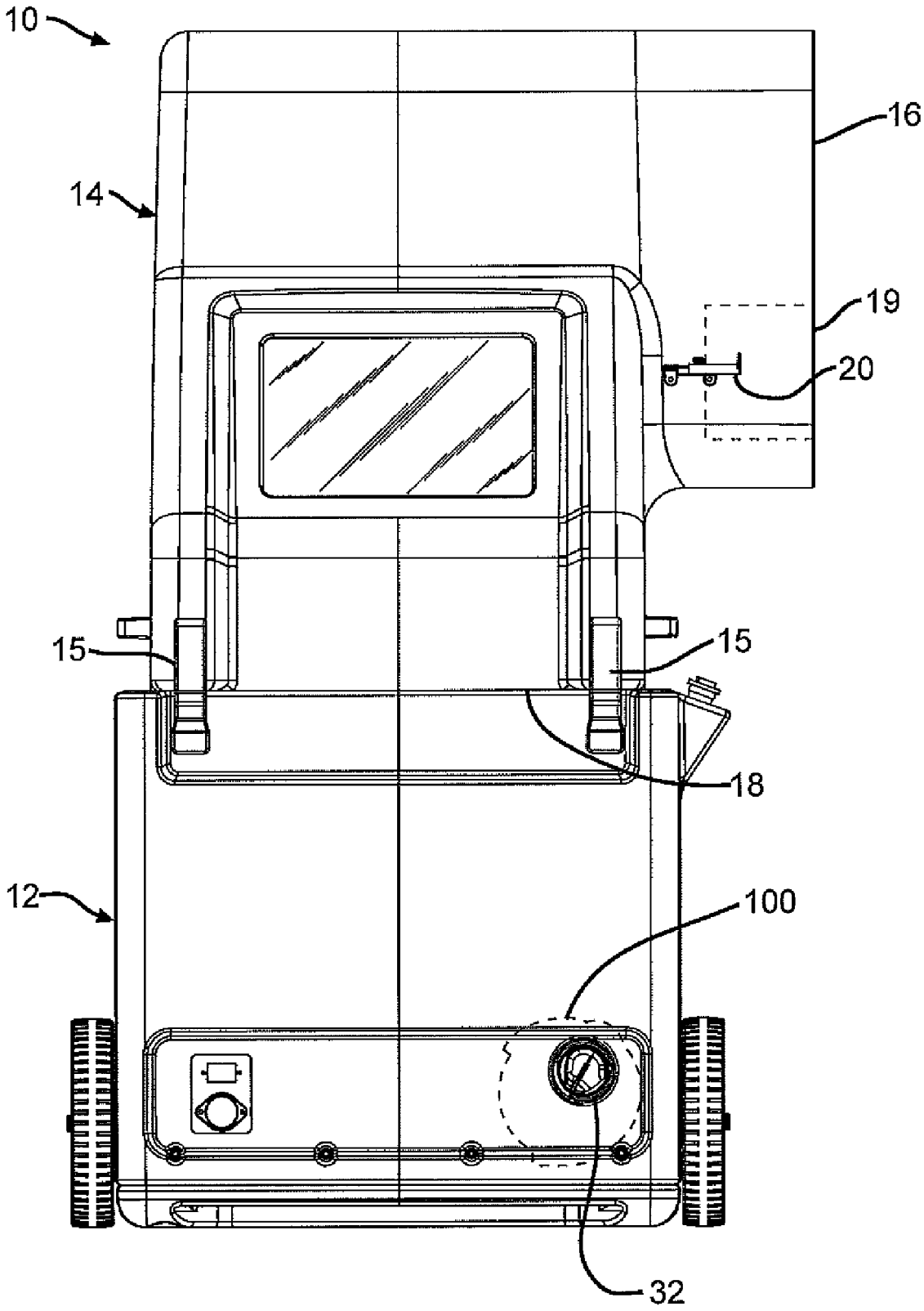
FIG. 1 is a front view in elevation of an insulation blowing wool machine.
Figure 2:
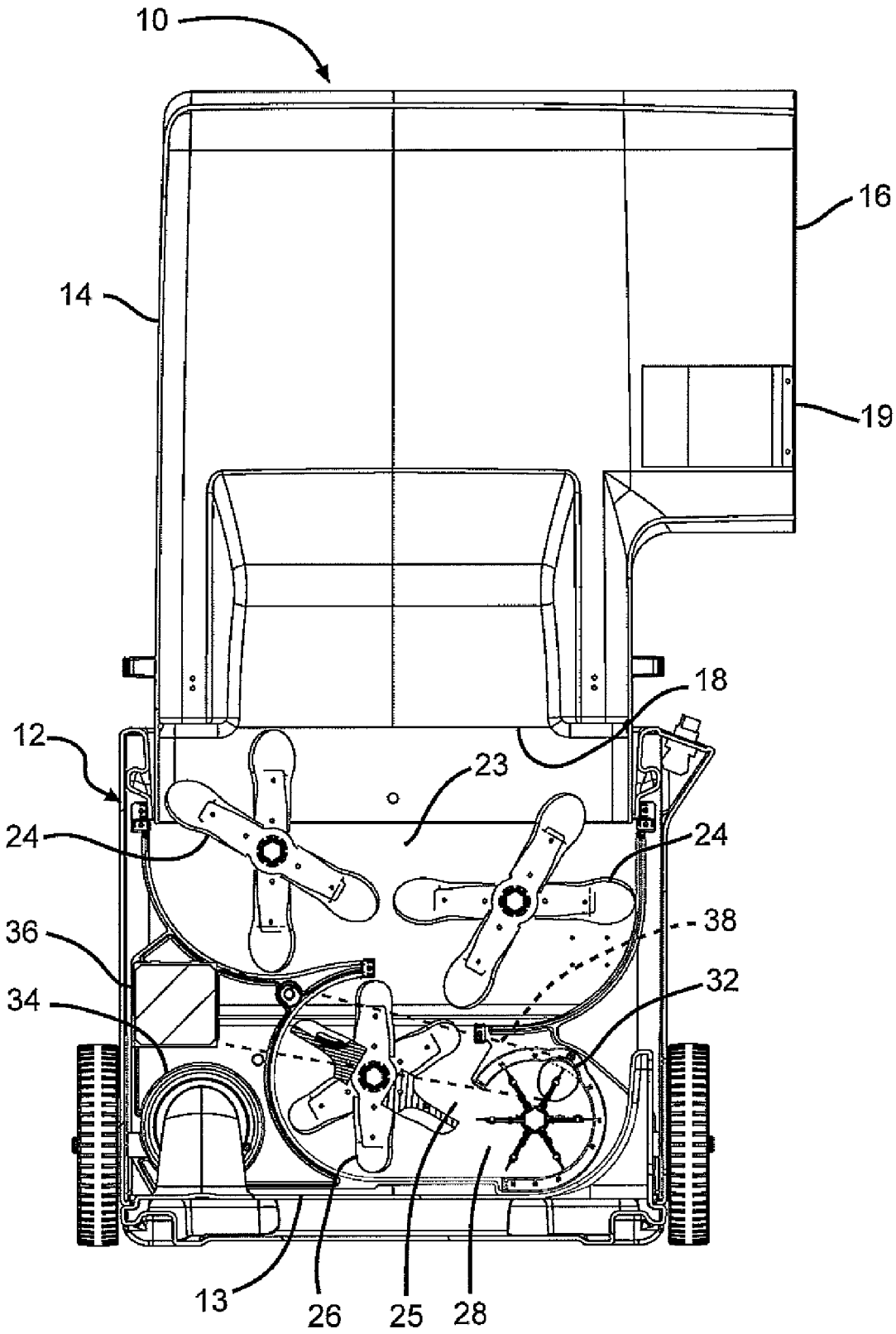
FIG. 2 is a front view in elevation, partially in cross-section, of the insulation blowing wool machine of FIG. 1.
Figure 3:
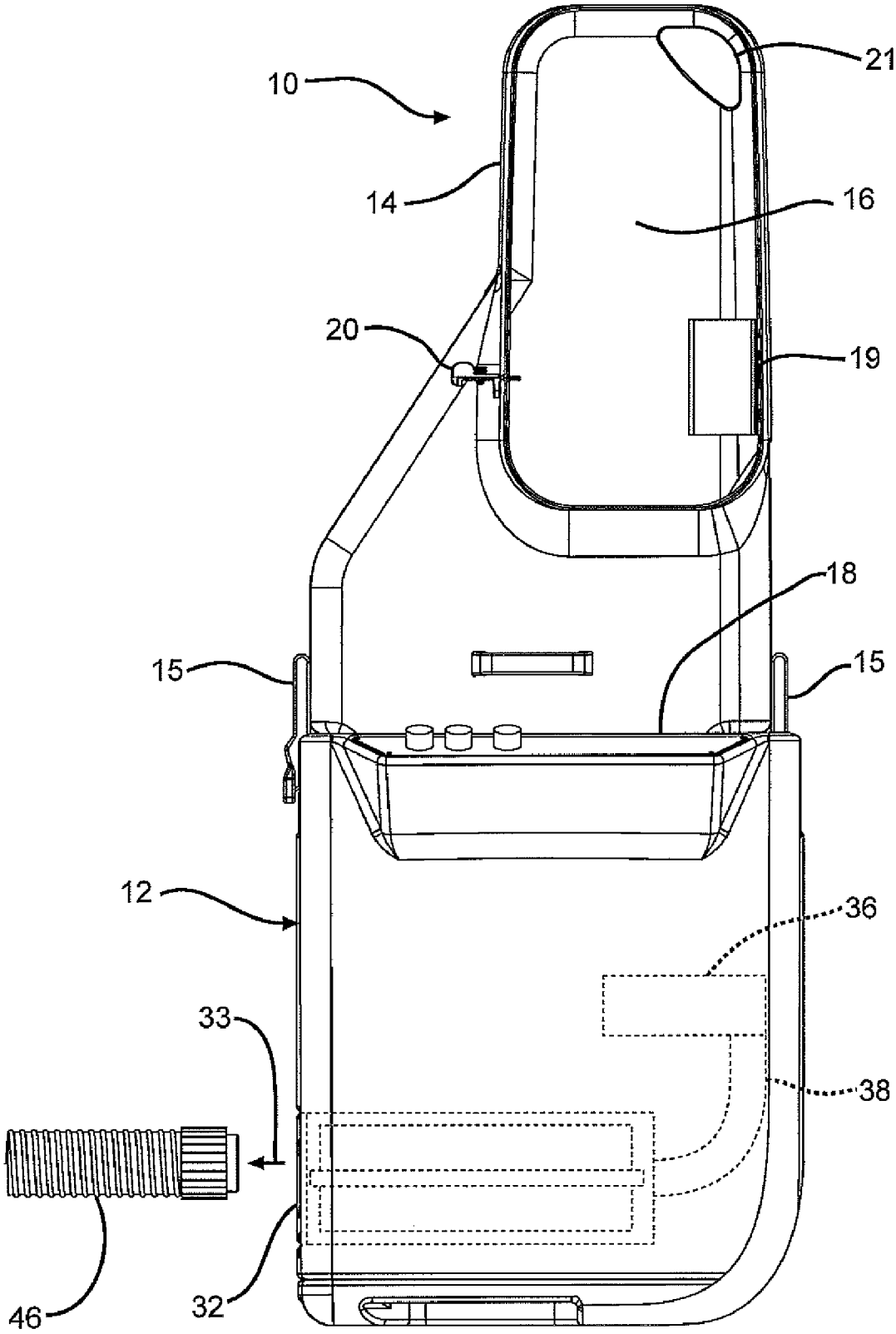
FIG. 3 is a side view in elevation of the insulation blowing wool machine of FIG. 1.

A blowing wool machine 10 for distributing compressed blowing wool is shown in FIGS. 1-3. The blowing wool machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive the blowing wool and introduce the blowing wool to the shredding chamber 23 as shown in FIG. 2. Optionally, the chute 14 includes a handle segment 21, as shown in FIG. 3, to facilitate ready movement of the blowing wool machine 10 from one location to another. However, the handle segment 21 is not necessary to the operation of the machine 10.

As further shown in FIGS. 1-3, the chute 14 includes an optional guide assembly 19 mounted at the inlet end 16 of the chute 14. The guide assembly 19 is configured to urge a package of compressed blowing wool against a cutting mechanism 20, shown in FIGS. 1 and 3, as the package moves into the chute 14.

As shown in FIG. 2, the shredding chamber 23 is mounted at the outlet end 18 of the chute 14. In this embodiment, the shredding chamber 23 includes a plurality of low speed shredders 24 and an agitator 26. The low speed shredders 24 shred and pick apart the blowing wool as the blowing wool is discharged from the outlet end 18 of the chute 14 into the lower unit 12. Although the blowing wool machine 10 is shown with a plurality of low speed shredders 24, any type of separator, such as a clump breaker, beater bar or any other mechanism that shreds and picks apart the blowing wool can be used.

As further shown in FIG. 2, the shredding chamber 23 includes an agitator 26 for final shredding of the blowing wool and for preparing the blowing wool for distribution into an airstream. In this embodiment as shown in FIG. 2, the agitator 26 is positioned beneath the low speed shredders 24. Alternatively, the agitator 26 can be disposed in any location relative to the low speed shredders 24, such as horizontally adjacent to, sufficient to receive the blowing wool from the low speed shredders 24. In this embodiment, the agitator 26 is a high speed shredder. Alternatively, any type of shredder can be used, such as a low speed shredder, clump breaker, beater bar or any other mechanism that finely shreds the blowing wool and prepares the blowing wool for distribution into an airstream.

In this embodiment the low speed shredders 24 rotate at a lower speed than the agitator 26. The low speed shredders 24 rotate at a speed of about 40-80 rpm and the agitator 26 rotates at a speed of about 300-500 rpm. In another embodiment, the low speed shredders 24 can rotate at speeds less than or more than 40-80 rpm and the agitator 26 can rotate at speeds less than or more than 300-500 rpm.

Referring again to FIG. 2, a discharge mechanism 28 is positioned adjacent to the agitator 26 and is configured to distribute the finely shredded blowing wool into the airstream. In this embodiment, the shredded blowing wool is driven through the discharge mechanism 28 and through a machine outlet 32 by an airstream provided by a blower 36 mounted in the lower unit 12. The airstream is indicated by an arrow 33 in FIG. 3. In another embodiment, the airstream 33 can be provided by another method, such as by a vacuum, sufficient to provide an airstream 33 driven through the discharge mechanism 28. In this embodiment, the blower 36 provides the airstream 33 to the discharge mechanism 28 through a duct 38 as shown in FIG. 2. Alternatively, the airstream 33 can be provided to the discharge mechanism 28 by another structure, such as by a hose or pipe, sufficient to provide the discharge mechanism 28 with the airstream 33.

The shredders 24, agitator 26, discharge mechanism 28 and the blower 36 are mounted for rotation. They can be driven by any suitable means, such as by a motor 34, or other means sufficient to drive rotary equipment. Alternatively, each of the shredders 24, agitator 26, discharge mechanism 28 and the blower 36 can be provided with its own motor.

In operation, the chute 14 guides the blowing wool to the shredding chamber 23. The shredding chamber 23 includes the low speed shredders 24 which shred and pick apart the blowing wool. The shredded blowing wool drops from the low speed shredders 24 into the agitator 26. The agitator 26 prepares the blowing wool for distribution into the airstream 33 by further shredding the blowing wool. The finely shredded blowing wool exits the agitator 26 at an outlet end 25 of the shredding chamber 23 and enters the discharge mechanism 28 for distribution into the airstream 33 provided by the blower 36. The airstream 33, with the shredded blowing wool, exits the machine 10 at the machine outlet 32 and flows through the distribution hose 46, as shown in FIG. 3, toward the insulation cavity, not shown.

Figure 4:
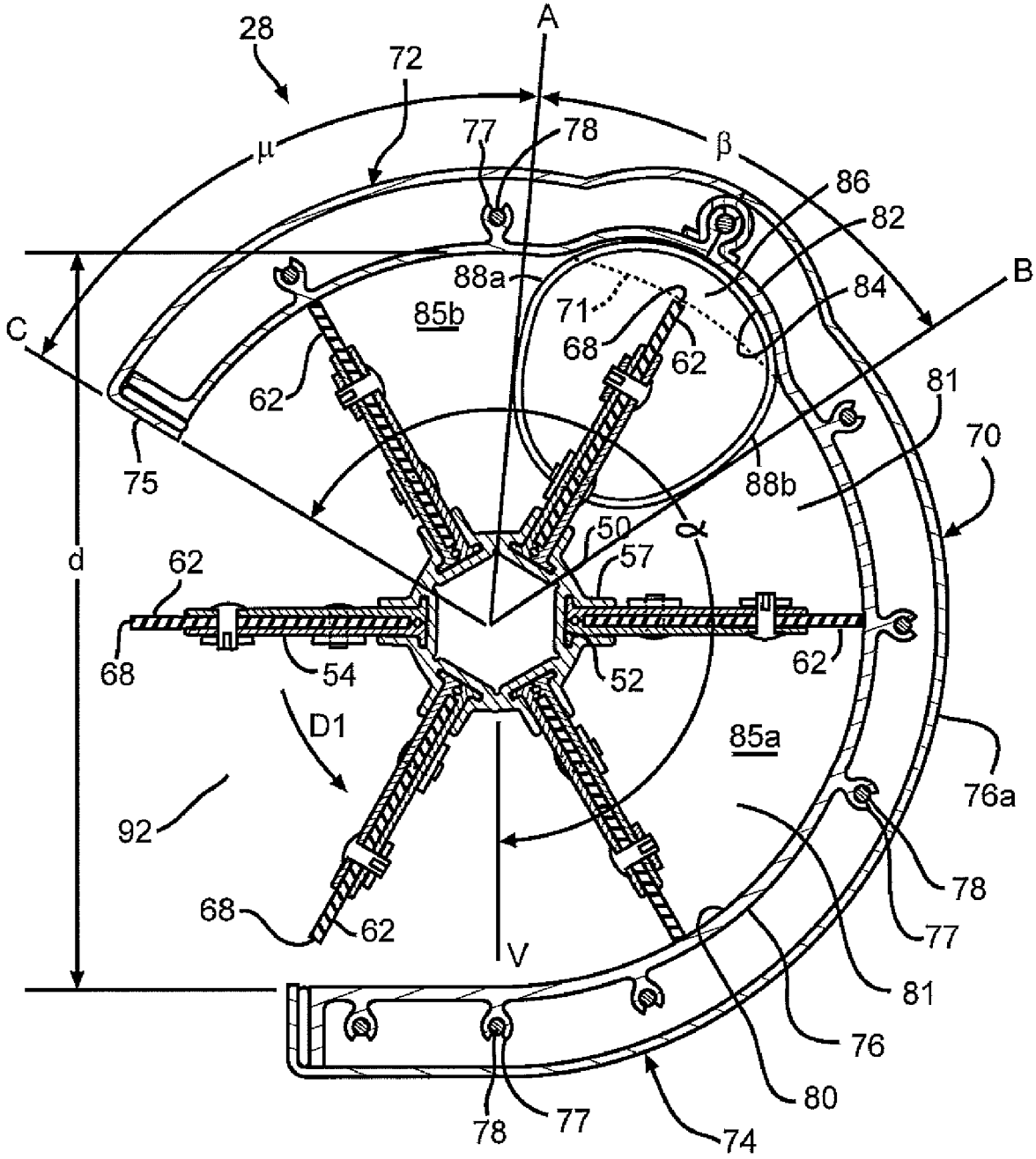
FIG. 4 is a cross-sectional view in elevation of a discharge mechanism of the insulation blowing wool machine of FIG. 1.

As previously discussed and as shown in FIG. 4, the discharge mechanism 28 is configured to distribute the finely shredded blowing wool into the airstream 33. In this embodiment, the discharge mechanism 28 is a rotary valve. Alternatively the discharge mechanism 28 can be any other mechanism including staging hoppers, metering devices, and rotary feeders, sufficient to distribute the shredded blowing wool into the airstream 33.

As shown in FIG. 4, the discharge mechanism 28 includes a valve shaft 50 mounted for rotation. In this embodiment, the valve shaft 50 is a hollow rod having a hexagonal cross-sectional shape. The valve shaft 50 is configured with flat hexagonal surfaces 52 and support members 57 which are used to seat a plurality of sealing vane assemblies 54. Alternatively, other cross-sectional shapes, such as a pentagonal cross-sectional shape, can be used.

In this embodiment the valve shaft 50 is made of steel, although the valve shaft 50 can be made of other materials, such as aluminum or plastic, or other materials sufficient to allow the valve shaft 50 to rotate with the seated sealing vane assemblies 54.

Figure 5:
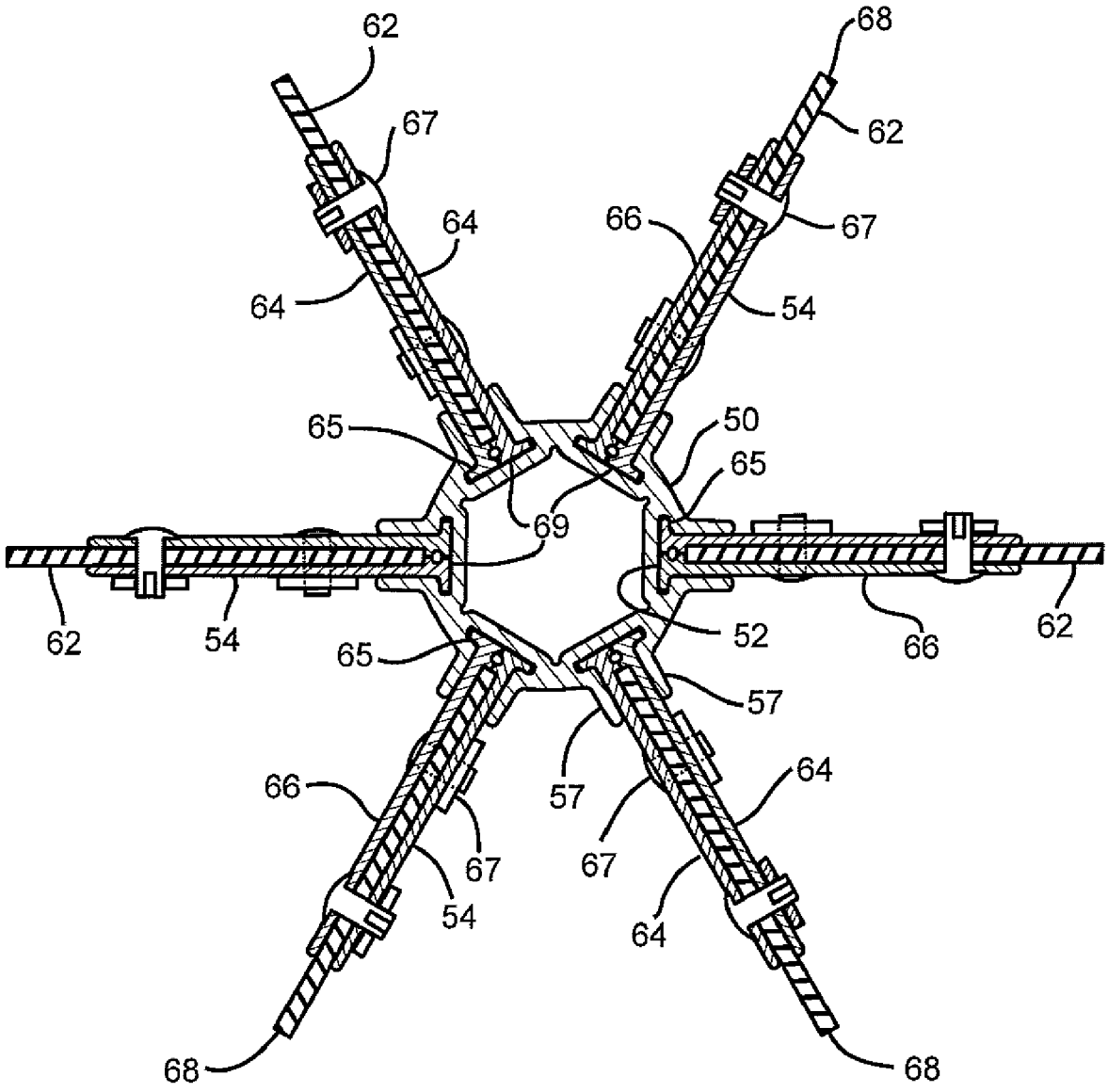
FIG. 5 is a cross-sectional view in elevation of a shaft and sealing vane assemblies of the discharge mechanism of FIG. 4.

Referring now to FIG. 5, a plurality of sealing vane assemblies 54 are assembled on the valve shaft 50 by seating them against the flat hexagonal surface 52 of the valve shaft 50. The sealing vane assemblies 54 are supported in place by the support members 57. Alternatively, the sealing vane assemblies 54 could be assembled on the valve shaft 50 by other fastening mechanisms, such as clamps, clips, bolts, sufficient to attach the sealing vane assemblies 54 to the valve shaft 50.

As shown in FIGS. 4 and 5, the sealing vane assemblies 54 include a sealing core 62 disposed between two opposing vane supports 64. The sealing core 62 includes a vane tip 68 positioned at the outward end of the sealing core 62. As shown in FIG. 4, the sealing vane assembly 54 is configured such that the vane tip 68 seals against a valve housing 70 as the sealing vane assembly 54 rotates within the valve housing 70. In this embodiment, the sealing core 62 is made from fiber-reinforced rubber. In another embodiment, the sealing core 62 can be made of other materials, such as polymer, silicone, felt, or other materials sufficient to seal against the valve housing 70. In this embodiment, the fiber-reinforced sealing core 62 has a hardness rating of about 50 A to 70 A as measured by a Durometer. The hardness rating of about 50 A to 70 A allows the sealing core 62 to efficiently seal against the valve housing 70 as the sealing vane assembly 54 rotates within the valve housing 70.

As further shown in FIG. 5, each vane support 64 includes a vane support base 65 and a vane support flange 66. The vane support bases 65 of the opposing vane supports 64 combine to form a T-shaped base 69 for each sealing vane assembly 54. As previously discussed, the T-shaped base 69 seats on the flat hexagonal surface 52 of the valve shaft 50. The support members 57 hold the T-shaped base 69 of the sealing vane assembly 54 against the hexagonal surface 52 of the valve shaft 50.

In this embodiment as shown in FIG. 5, the sealing core 62 is attached to the vane support flanges 66 by a plurality of vane rivets 67. Alternatively, the sealing core 62 can be attached to the vane support flanges 66 by sonic welding, adhesives, mechanical fasteners, or other fastening methods sufficient to attach the sealing core 62 to the vane support flanges 66. As shown in FIG. 5, the vane support flanges 66 are made of ABS plastic. In another embodiment the vane support flanges 66 can be made of other materials, including extruded aluminum or brass, sufficient to support the sealing core 62 as the sealing vane assembly 54 rotates within the valve housing 70.

Referring again to FIG. 4, the sealing vane assemblies 54, assembled on the valve shaft 50, rotate within the valve housing 70 in a counter-clock wise direction as indicated by the arrow D1. In this embodiment, the valve housing 70 is made from an aluminum extrusion, although the valve housing 70 can be made from other materials, including brass or plastic, sufficient to form a housing within which sealing vane assemblies 54 rotate. In this embodiment as shown in FIG. 4, the valve housing 70 includes a top housing segment 72 and a bottom housing segment 74. In another embodiment, the valve housing 70 can be made of a single segment or the valve housing 70 can be made of more than two segments.

As shown in FIG. 4, the valve housing includes an inner housing wall 76 and an optional outer housing wall 76*a*. The inner housing wall 76 has an inner housing surface 80. Optionally, the inner housing surface 80 can have a coating to provide a low friction and extended wear surface. One example of a low friction coating is a chromium alloy although other materials may be used. Alternatively, the inner housing surface 80 may not be coated with a low friction and extended wear surface.

The top housing segment 72 and the bottom housing segment 74 are attached to the lower unit 12 by housing fasteners 78. In this embodiment, the housing fasteners 78 are bolts extending through mounting holes 77 disposed in the top housing segment 72 and the bottom housing segment 74. In another embodiment, the top housing segment 72 and the bottom housing segment 74 can be attached to the lower unit 12 by other mechanical fasteners, such as clips or clamps, or by other fastening methods including sonic welding or adhesive.

As shown in FIG. 4, the valve housing 70 is curved and extends to form a segment having a generally circular shape. The curved portion of the valve housing 70 has an end 75. A valve housing wrap angle $\alpha$ extends from a substantially vertical axis V centered on the shaft 50 to the end 75 of the valve housing 70. In this embodiment, the valve housing wrap angle $\alpha$ is approximately 240°. Alternatively, the valve housing 70 can form other circular segments having other desired valve housing wrap angles. The circular segment having the valve housing wrap angle $\alpha$ will be discussed in more detail below.

The generally circular shape of the valve housing 70 has an approximate inside diameter d which is approximately the same diameter of an are 71 formed by the vane tips 68 of the rotating sealing vane assemblies 54. In operation, the vane tips 68 of the sealing vane assemblies 54 seal against the inner housing surface 80 such that finely shredded blowing wool entering the discharge mechanism 28 is contained within a wedge-shaped space 81 defined by adjacent sealing vane assemblies 54 and the inner housing surface 80. The containment of the shredded blowing wool within adjacent vane assemblies 54 will be discussed in more detail below.

Figure 6:
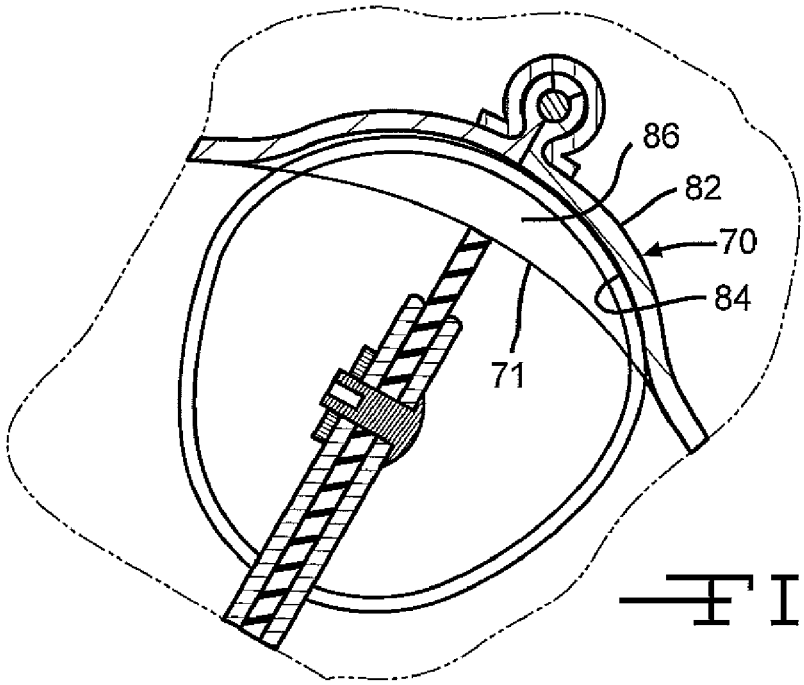
FIG. 6 is a cross-sectional view in elevation of the airstream and eccentric region of the discharge mechanism of FIG. 4.

As shown in FIGS. 4 and 6, the valve housing 70 includes an eccentric segment 82. The eccentric segment 82 extends from or bulges out from the circular sector of the top housing segment 72 and the bottom housing segment 74. In this embodiment, the eccentric segment 82 has an approximate cross-sectional shape of a dome. The term "dome" as used herein, is defined to mean a generally symmetrical concave shape having a generally rounded surface, wherein the concavity faces toward the shaft 50. Alternatively, the eccentric segment 82 can have other cross-section shapes that extend from the top housing segment 72 and the bottom housing segment 74.

The eccentric segment 82 includes an inner eccentric surface 84. As shown in FIG. 6, the eccentric segment 82 forms an eccentric region 86 which is defined as the area bounded by the inner eccentric surface 84 and the arc 71 formed by the vane tips 68 of the rotating sealing vane assemblies 54. The eccentric region 86 is within the airstream 33 flowing through the discharge mechanism 28. In operation, as a sealing vane assembly 54 rotates into the airstream 33, the vane tip 68 of the sealing vane assembly 54 becomes spaced apart from the inner housing surface 80 of the valve housing 70. As the sealing vane assembly 54 further rotates within the eccentric region 86, the airstream 33 flows along the vane tip 68, thereby forcing any particles of blowing wool caught on the vane tip 68 to be blown off. This clearing of the sealing vane assembly 54 assists in prevents a buildup of shredded blowing wool from forming on the sealing vane assembly 54.

As shown in FIG. 4, the eccentric region 86 has an eccentric region left edge 88*a* and an eccentric region right edge 88*b*. The eccentric region left edge 88*a* is defined by a major axis A extending from the center of the shaft 50 and the eccentric region right edge 88*b* is defined by a major axis B extending from the center of the shaft 50. An eccentric region angle $\beta$ is formed between the eccentric region left edge 88*a* and the eccentric region right edge 88*b*. The eccentric region angle $\beta$ is the same as an angle between two adjacent sealing vane assemblies 54. In this embodiment, the eccentric region angle $\beta$ is approximately 60°. In other embodiments, the eccentric region angle $\beta$ can be more or less than approximately 60° and can be a different angle than the angle between two adjacent sealing vane assemblies 54.

Referring again to FIG. 4, as the sealing vane assemblies 54 rotate in the counter-clockwise direction D1, the wedge shaped spaces 81 occurring before the eccentric region 86 define a pre-airstream area, indicated generally at 85*a*. Similarly, the wedge shaped spaces 81 occurring after the eccentric region 86 define a post-airstream area, indicated generally at 85*b*.

As shown in FIG. 4, the major axis A, defining the eccentric region left edge 88*a* forms an angle μ, with a major axis C, defined by the valve housing end 75. In order for a sealing vane assembly 54 to seal against the valve housing 70 in the post-airstream region 85*b*, the angle μ has a minimum dimension greater than the eccentric region angle β. In this embodiment, the angle μ has a minimum dimension greater than approximately 60°. In other embodiments, the angle μ can be in a range greater than about approximately 60° to approximately 120°.

Referring again to FIG. 4, the top and bottom housing segments 72 and 74 do not completely enclose the valve housing 70, thereby forming a side inlet 92. The side inlet 92 is configured to receive the finely shredded blowing wool as it is fed from the agitator 26. Positioning the side inlet 92 of the discharge mechanism 28 at the side of the discharge mechanism 28 allows finely shredded blowing wool to be fed approximately horizontally into the discharge mechanism 28. Horizontal feeding of the blowing wool from the agitator 26 to the discharge mechanism 28 is defined to include the feeding of blowing wool in a direction that is substantially parallel to a floor 13 of the lower unit 12 as best shown in FIG. 2. Feeding finely shredded blowing wool horizontally into the discharge mechanism 28 allows the discharge mechanism 28 to be positioned at a lower location within the lower unit 12, thereby allowing the blowing wool machine 10 to be more compact. In this embodiment, the agitator 26 is positioned to be adjacent to the side inlet 92 of the discharge mechanism 28. In another embodiment, a low speed shredder 24, or a plurality of shredders 24 or agitators 26, or another mechanism can be adjacent to the side inlet 92, such that finely shredded blowing wool is fed horizontally into the side inlet 92.

Without being bound by the theory, it is believed that as the sealing vane assemblies 54 rotate within the valve housing 70 and the vane tips 68 seal against the inner housing surface 80, the vane tips 68 deform such that a portion of the vane tip 68 trails the sealing vane assembly 54. Accordingly, the pressure caused by the airstream 33 within the valve housing 70 has a different result on the vane tips 68 of the rotating sealing vane assemblies 54 in the pre-airstream area 85*a* from the result on vane tips 68 of the rotating sealing vane assemblies 54 in the post-airstream area 85*b*. It is believed that the air pressure from the airstream 33 causes the vane tips 68 in the pre-airstream area 85*a* to lift away from the inner housing surface 80, thereby decreasing the sealing action of the vane tip 85*a* against the inner housing surface 80. In contrast, it is believed that the air pressure from by the airstream 33 on the vane tips 68 in the post-airstream area 85*b* reinforces the sealing action on the inner housing surface 80, thereby increasing the sealing action of the vane tip 85*a* against the inner housing surface 80.

Accordingly, as shown in FIG. 4, the discharge mechanism 28 has been configured to combine a valve housing 70 having a valve housing wrap angle α of approximately 240° with the positioning of the eccentric region 86 to result in at least two sealing vane assemblies 54 to be simultaneously in contact with the inner housing surface 80 in the pre-airstream area 85*a* while maintaining at least one sealing vane assembly 54 in contact with the inner housing surface 80 in the post-stream area 85*b*. This configuration provides significant benefits in the operation of the blowing wool machine 10.

First, the increased sealing action of the vane tips 85*a* in both the pre-airstream and post-airstream areas, 85*a* and 85*b*, allows for increased airstream pressure. In the illustrated embodiment, the airstream pressure is within a range of from about 1.5 psi to about 3.0 psi. In other embodiments, the airstream pressure can be less than about 1.5 psi or more than about 3.0 psi.

Second, operating the airstream at a higher pressure results in more throughput of shredded blowing wool. The term "throughput" as used herein, is defined to mean the weight of the shredded blowing wool over a period of time, delivered through the distribution hose 46. In the illustrated embodiment, the throughput of blowing wool material is in a range of from between 10.0 lbs/min to about 15.0 lbs/min. In other embodiments, the throughput of the shredded blowing wool can be less than about 10.0 lbs/min or more than about 15.0 lbs/min.

Third, by increasing sealing action of the vane tips 85*a* in both the pre-airstream and post-airstream areas, 85*a* and 85*b*, the number of sealing vane assemblies 54 can be kept to a minimum. If the number of sealing vane assemblies 54 were increased, either the area of the wedge-shaped spaces 81 would be too small to adequately feed the shredded blowing wool, or the diameter d of the discharge mechanism 28 would have to be increased, resulting in a larger blowing wool machine 10. In such a case, a higher resistance to rotation would require an increased electrical power load.

Figure 7:
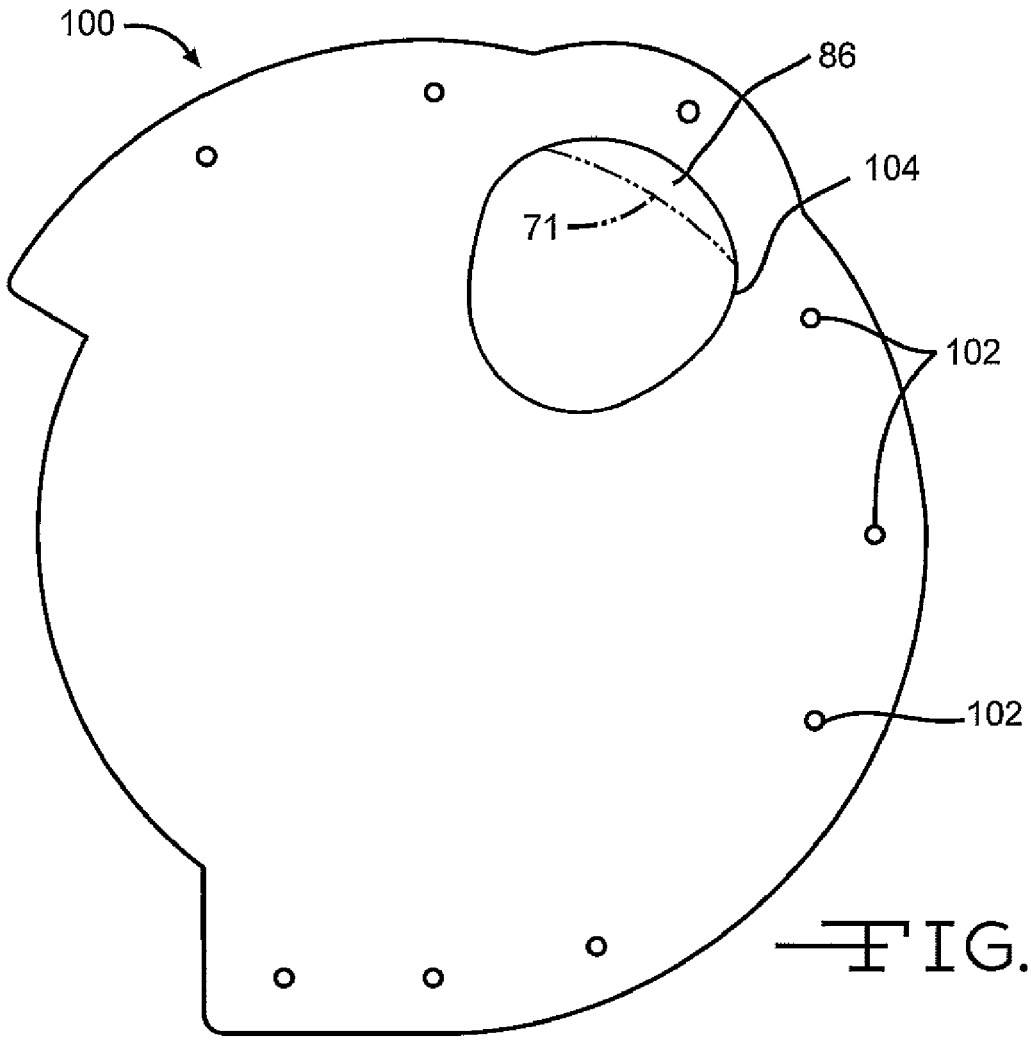
FIG. 7 is a side view in elevation of an end outlet plate of the blowing wool machine of FIG. 1.

The discharge mechanism 28 further includes an end outlet plate 100 as shown in FIGS. 1 and 7. The end outlet plate 100 covers the outlet end of the discharge mechanism 28 at the machine outlet 32. The end outlet plate 100 includes optional mounting holes 102 and an airstream opening 104. In this embodiment, the airstream opening 104 includes the eccentric region 86. In another embodiment, the airstream opening 104 can be any shape sufficient to discharge shredded blowing wool from the discharge mechanism 28.

The principle and mode of operation of this blowing wool machine have been described in its preferred embodiments. However, it should be noted that the blowing wool machine may be practiced otherwise than as specifically illustrated and described without departing from its scope.

What is claimed is:

1. A machine for distributing blowing wool from a bag of compressed blowing wool, the machine comprising:

a shredding chamber having an outlet end, the shredding chamber including a plurality of shredders configured to shred and pick apart the blowing wool;

a discharge mechanism mounted to the outlet end of the shredding chamber and configured for distributing the blowing wool into an airstream, the discharge mechanism including a housing, a side inlet, an eccentric region and a plurality of sealing vane assemblies mounted for rotation, the housing including an eccentric segment that bulges from the housing to define the eccentric region, the housing having a housing end, the housing having a wrap angle of approximately 240° measured from the housing end to a substantially vertical axis centered on a discharge mechanism shaft, the sealing vane assemblies being configured to seal against the housing as the sealing vane assemblies rotate, the eccentric region having a left edge and a right edge; and a blower configured to provide the airstream flowing through the discharge mechanism;

wherein the left edge of the eccentric region forms an angle of at least 60° with the housing end.

2. The machine of claim 1 in which the housing includes an inner housing surface, the inner housing surface having a chromium alloy coating.

3. The machine of claim 1 in which the housing comprises at least two segments.

4. The machine of claim 1 in which the eccentric region is defined as an area between an arc formed by tips of the rotating sealing vane assemblies and an inner eccentric surface.

5. The machine of claim 1 in which the eccentric portion is dome shaped.

6. A machine for distributing blowing wool from a bag of compressed blowing wool, the machine comprising:

a shredding chamber having an outlet end, the shredding chamber including a plurality of shredders configured to shred and pick apart the blowing wool;

a discharge mechanism mounted to the outlet end of the shredding chamber and configured for distributing the blowing wool into an airstream, the discharge mechanism including a housing, an eccentric region and a plurality of sealing vane assemblies mounted for rotation, the housing including an eccentric segment that bulges from the housing to define the eccentric region, the housing having a top housing segment and a bottom housing segment, the eccentric region positioned between the top housing segment and the bottom housing segment, the eccentric region having a left edge and a right edge, the left edge and right edge of the eccentric region forming an angle; and a blower configured to provide the airstream flowing through the discharge mechanism;

wherein the left edge of the eccentric region forms an angle with a housing end that is greater than the angle formed between the left edge and right edge of the eccentric region.

7. The machine of claim 6 in which the angle formed between the left edge of the eccentric region and the housing end is approximately 60°.

* * * * *